US007198593B2

(12) United States Patent
Spatafora

(10) Patent No.: US 7,198,593 B2
(45) Date of Patent: Apr. 3, 2007

(54) CUTTING UNIT FOR CUTTING BLANKS FOR COLLARS OF RIGID CIGARETTE PACKETS

(75) Inventor: Mario Spatafora, Granarolo (IT)

(73) Assignee: G.D Societa' per Azioni, Bologna (IT)

( * ) Notice: Subject to any disclaimer, the term of this patent is extended or adjusted under 35 U.S.C. 154(b) by 125 days.

(21) Appl. No.: 11/108,213

(22) Filed: Apr. 18, 2005

(65) Prior Publication Data

US 2005/0235792 A1 Oct. 27, 2005

(30) Foreign Application Priority Data

Apr. 19, 2004 (IT) ..... BO 2004 A 000222

(51) Int. Cl.
*B31B 1/20* (2006.01)
*B26D 1/06* (2006.01)

(52) U.S. Cl. ..... 493/473; 83/55

(58) Field of Classification Search ..... 493/429, 493/431, 86, 473; 83/55, 862, 202, 203, 83/221, 598, 599, 694; 53/456, 462
See application file for complete search history.

(56) References Cited

U.S. PATENT DOCUMENTS 4,843,798 A * 7/1989 Focke et al. ..... 53/453
5,152,737 A 10/1992 Wu et al.
6,106,453 A * 8/2000 Sinn et al. ..... 493/473
6,112,505 A * 9/2000 Minarelli et al. ..... 53/462
2005/0079969 A1* 4/2005 Jornborn et al. ..... 493/434

FOREIGN PATENT DOCUMENTS

| | | |
|---|---|---|
| DE | 22 18 999 | 11/1973 |
| EP | 1 013 557 | 6/2000 |
| EP | 1 103 369 | 5/2001 |

* cited by examiner

*Primary Examiner*—Stephen Choi
(74) *Attorney, Agent, or Firm*—Marshall, Gerstein & Borun LLP

(57) ABSTRACT

A cutting unit for cutting blanks for collars of rigid cigarette packets, wherein a continuous strip of packing material is fed in a given direction through a cutting station equipped with a knife having an incision member and a blade, and with a fixed cutting block having a counterblade; the knife oscillates, about a fixed axis crosswise to the travelling direction of the strip, to and from a work position in which the incision member cooperates with a contact surface of the cutting block to incise a portion of the strip upstream from the counterblade, and the blade is located beyond the counterblade to cut the strip along a cutting line.

6 Claims, 3 Drawing Sheets

CUTTING UNIT FOR CUTTING BLANKS FOR COLLARS OF RIGID CIGARETTE PACKETS

CROSS-REFERENCE TO RELATED APPLICATION

This application claims the benefit of Italian patent application number BO2004A 000222, filed Apr. 19, 2004.

The present invention relates to a cutting unit for cutting blanks for collars of rigid cigarette packets.

More specifically, the present invention relates to a cutting unit for cutting blanks for collars of rigid cigarette packets, the cutting unit being of the type comprising a cutting station; a feed line for feeding a continuous strip of packing material in a given direction along a feed path extending through the cutting station; and a cutting device located at the cutting station to cut the strip into a succession of blanks; the cutting device comprising a fixed cutting block having a counterblade; a knife mounted to rotate about a fixed axis of rotation crosswise to said direction, and having a blade cooperating scissor-fashion with the counterblade; and actuating means connected to the knife to oscillate the knife, about said axis of rotation, between a first position in which the knife and the cutting block are located on opposite sides of the feed path, and a second position in which the blade and the counterblade are located on the same side of the feed path.

BACKGROUND OF THE INVENTION

On cigarette packing machines for producing rigid hinged-lid packets of cigarettes, a cutting unit of the type described above is used in combination with an incision unit comprising one or more movable members for forming longitudinal fold lines on the continuous strip at an incision station located upstream from the cutting station.

Producing collar blanks as described above calls for respective movable members with respective actuating devices at both the incision and cutting stations, and for extremely accurate positioning of the incision station with respect to the cutting station, thus complicating the mechanics and increasing the cost of the cutting unit.

SUMMARY OF THE INVENTION

It is an object of the present invention to provide a cutting unit for cutting blanks for collars of rigid cigarette packets, designed to eliminate the aforementioned drawbacks, and which is cheap and easy to produce.

According to the present invention, there is provided a cutting unit for cutting blanks for collars of rigid cigarette packets, as claimed in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
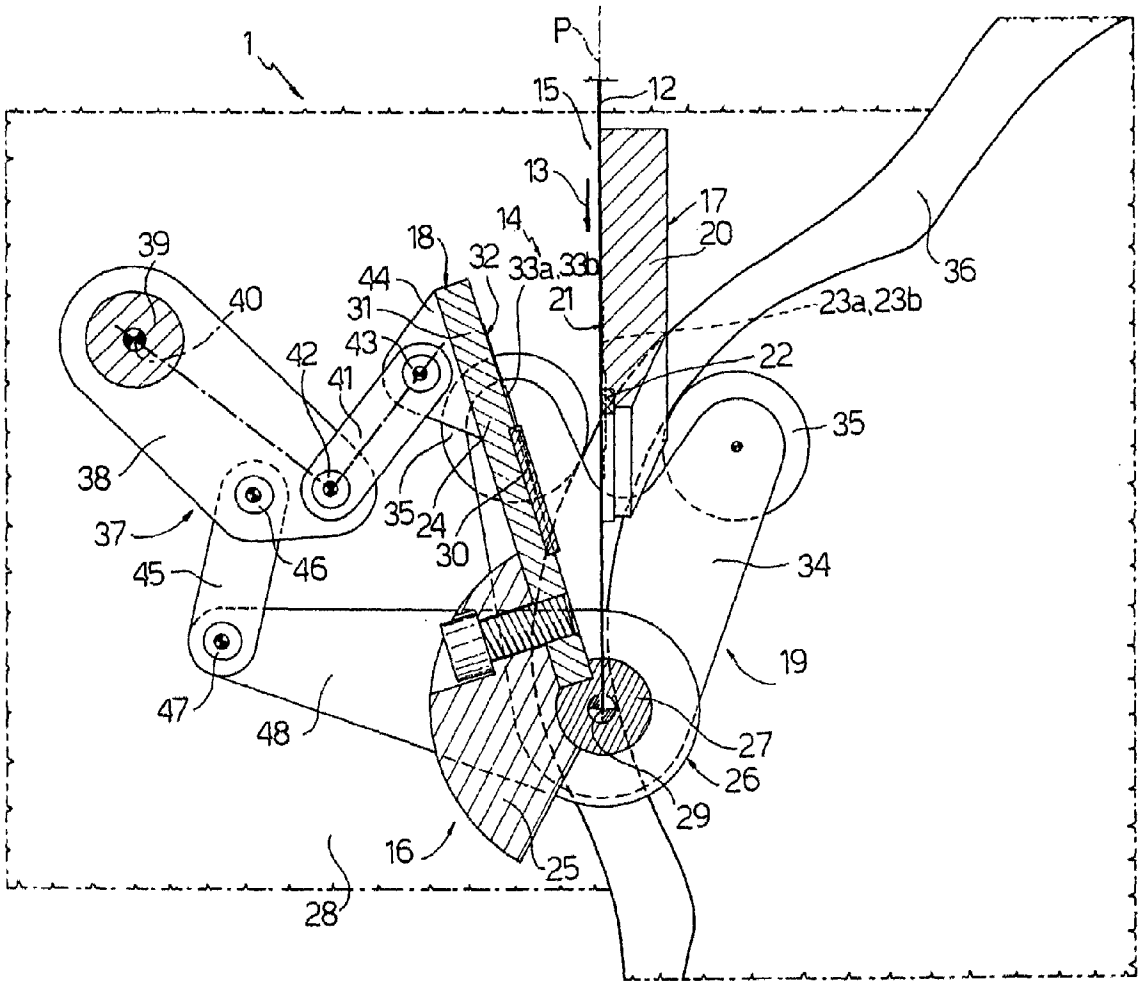
FIG. 1 shows a partly sectioned side view of a preferred embodiment of the cutting unit according to the present invention.

Number 1 in FIG. 1 indicates as a whole a cutting unit for producing collars 2 for rigid cigarette packets (not shown).

Figure 4:
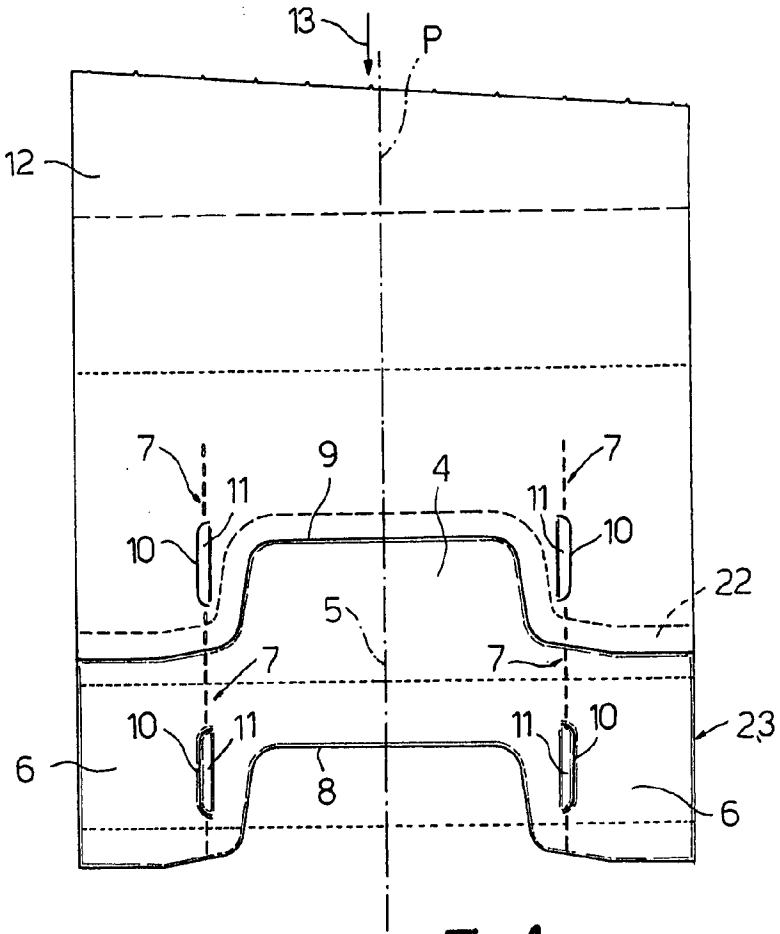
FIG. 4 shows a front view of a detail in FIG. 2.

As shown in FIG. 4, each collar 2 is formed from a flat blank 3 comprising a central panel 4, which has an axis 5 of symmetry and is connected laterally to two lateral panels 6, specular with respect to axis 5, along respective fold lines 7 parallel to and symmetrical with respect to axis 5. Along each fold line 7, which extends between two identical opposite end edges 8 and 9 of flat blank 3, a C-shaped through slit 10 is formed which, when relative lateral panel 6 is folded squarely with respect to central panel 4 about relative fold line 7, defines a respective wing 11 projecting outwards of the relative folded lateral panel 6.

Each blank 3 is formed by transversely cutting, along relative edges 8 and 9, a continuous strip 12 of cardboard or similar having a longitudinal axis coincident with axis 5, and which is step-fed in a direction 13, and along a path P extending through a cutting station 14, by a feed line 15 forming part of cutting unit 1 (and only an end portion of which is shown).

In addition to feed line 15, cutting unit 1 also comprises a cutting device 16 located at cutting station 14 and in turn comprising a fixed cutting block 17; a knife 18 movable to and from cutting block 17 to cut each blank 3 along relative edges 8 and 9; and an actuating device 19 for activating knife 18.

Figure 3:
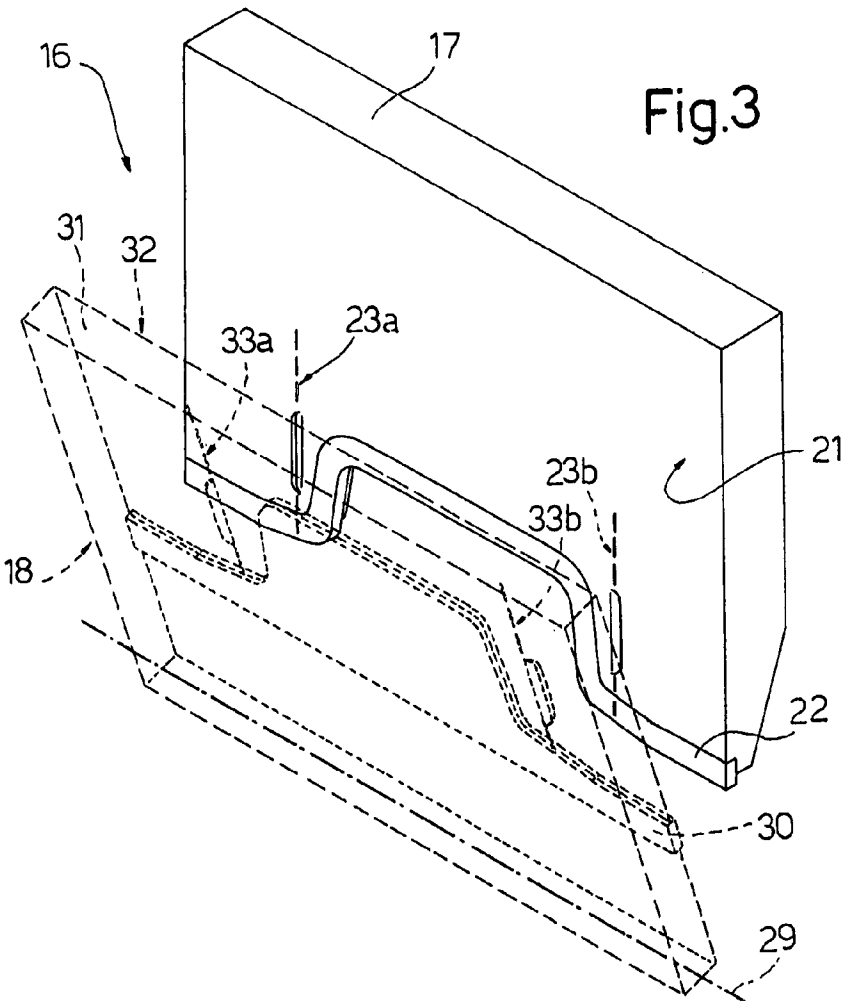
FIG. 3 shows a view in perspective of a detail in FIG. 1.

Cutting block 17 is defined by a plate 20 having a front contact surface 21, which faces knife 18, is tangent to path P, and is located on the opposite side of path P to knife 18. Plate 20 is bounded, at a rear end (in the travelling direction 13 of strip 12) by a counterblade 22 integral with plate 20, positioned crosswise to direction 13, and shaped to reproduce edges 8 and 9. As shown in FIG. 3, longitudinal slits 23*a*, 23*b*, of the same shape and size as respective fold lines 7 and respective slits 10 of a blank 3, are formed on surface 21.

Knife 18 is defined by a plate 24 connected rigidly at one end to one arm 25 of a rocker arm 26, which forms part of actuating device 19 and is hinged by a pin 27 to a frame 28 to oscillate about an axis 29 crosswise to path P and coplanar with surface 21, and to move knife 18 between a withdrawn rest position (FIG. 1) in which knife 18 is positioned outwards of path P and facing cutting block 17, and a forward work position (FIG. 2) in which knife 18 rests against cutting block 17.

As shown in FIG. 3, an intermediate portion of plate 24 is fitted with a blade 30, which projects from plate 24 towards cutting block 17, has a front edge shaped to reproduce edges 8 and 9, and cooperates scissor-fashion with counterblade 22 to cut strip 12 transversely when knife 18 is in the forward work position. An end portion of plate 24, upstream from blade 30 in direction 13, defines an incision member 31, which has a flat surface 32 facing surface 21 of cutting block 17, and comprises incision elements 33*a* and 33*b* projecting from surface 32 and which cooperate with longitudinal slits 23*a* and 23*b* in surface 21 to form respective fold lines 7 and respective slits 10.

Figure 2:
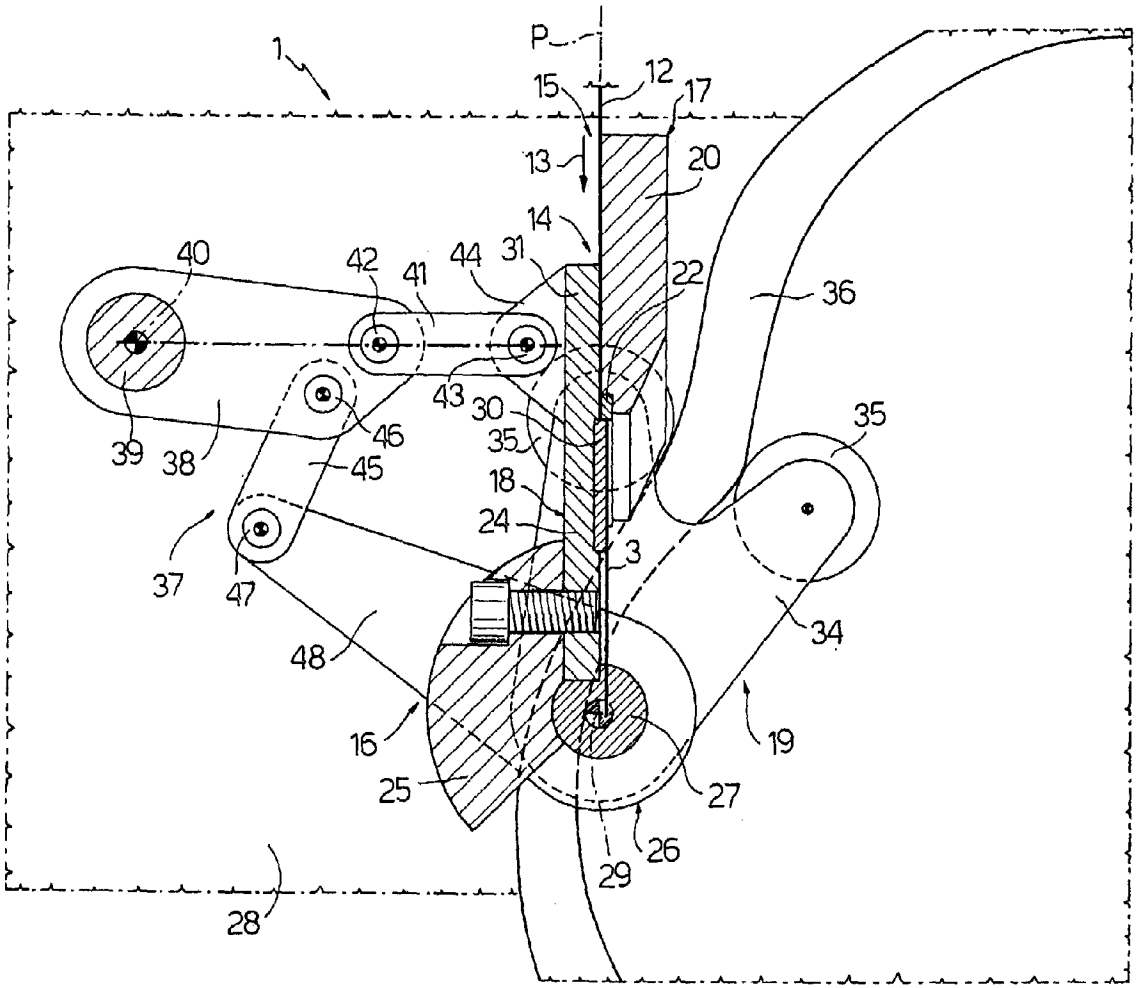
FIG. 2 is similar to FIG. 1, and shows the cutting unit in a different operating configuration.

As shown in FIGS. 1 and 2, in addition to arm 25, rocker arm 26 also comprises a V-shaped arm 34 fitted at one end to pin 27, and fitted at its two free ends with respective cam followers 35, which engage opposite surfaces of a double cam 36 forming part of actuating device 19 and fitted to frame 28 to rotate about a respective axis (not shown) parallel to axis 29. Double cam 36 is designed to oscillate rocker arm 26 in a constant sequence of operating cycles, in each of which, knife 18 moves from the withdrawn rest position to the forward work position and vice versa, and, in use, is activated in time with feed line 15 so that each operating cycle corresponds to one step of strip 12 along path P.

As shown in FIGS. 1 and 2, actuating device 19 also comprises a reaction assembly 37 connected to knife 18 and in turn comprising a crank 38 hinged to frame 28 by a pin 39 to oscillate about a respective axis 40 parallel to axis 29. Reaction assembly 37 also comprises a connecting rod 41, one end of which is hinged to the free end of crank 38 by a respective pin 42 parallel to axis 29, and the other end of which is hinged, by a pin 43 parallel to axis 29, to a bracket 44 connected rigidly to a surface of incision member 31 opposite surface 32.

Reaction assembly 37 also comprises a further connecting rod 45, the ends of which are hinged, by means of respective pins 46 and 47 parallel to axis 29, to an intermediate portion of crank 38, and, respectively, to a free end of an arm 48, which is fitted to pin 27, is integral with arm 25, and projects beyond arm 25.

In use, oscillation of rocker arm 26 about axis 29 is therefore transmitted by arm 48 and connecting rod 45 to crank 38, which is movable between a lowered position (FIG. 1) corresponding to the withdrawn rest position of knife 18 and in which crank 38 and connecting rod 41 are perpendicular to each other, and a raised position (FIG. 2) corresponding to the forward work position of knife 18 and in which crank 38 and connecting rod 41 are aligned with each other and substantially perpendicular to surfaces 32 and 21.

Operation of cutting device 16 will now be described as of the instant in which strip 12, step-fed by feed line 15 along path P, is arrested in front of surface 21 with an end portion projecting beyond counterblade 22. At this point, knife 18, initially in the withdrawn rest position (FIG. 1), is activated to move into the forward work position (FIG. 2). In the course of this step, blade 30 moves through path P and, cooperating scissor-fashion with counterblade 22, transversely cuts the end portion of the strip projecting beyond counterblade 22 to form a blank 3. At the same time, incision member 31 strikes surface 21 and grips, between surface 21 and surface 32, a portion of strip 12 as long as blank 3 and located immediately upstream from counterblade 22 to form two fold lines 7 and two slits 10 by means of incision elements 33*a* and 33*b*.

In connection with the above, it should be pointed out that reaction assembly 37 provides not only for completing the travel of knife 18 towards cutting block 17, by virtue of crank 38 and connecting rod 41, aligned by connecting rod 45 and arm 48, pressing incision member 31 against surface 21, but also for discharging the reaction, transmitted by cutting block 17 to knife 18, directly on pin 39 and so preventing it from being transmitted to rocker arm 26.

Cutting unit 1 therefore provides for producing from a strip 12, at one cutting station 14 and by means of one cutting device 16, a succession of blanks 3 with respective fold lines 7 and respective slits 10, by cutting each blank 3 along a relative edge 9 and, at the same time, forming fold lines 7 and slits 10 on the portion of strip 12 immediately upstream from edge 9.

The invention claimed is:

1. A cutting unit for cutting blanks for collars of rigid cigarette packets, comprising a cutting station (14); a feed line (15) for feeding a continuous strip (12) of packing material in a given direction (13) along a given feed path (P) extending through the cutting station (14); and a cutting device (16) located at the cutting station (14) to cut the strip (12) into a succession of blanks (3); the cutting device (16) comprising a fixed cutting block (17) having a counterblade (22); a knife (18) mounted to rotate about a fixed axis (29) of rotation crosswise to said direction (13), and having a blade (30) cooperating with the counterblade (22); and actuating means (19) connected to the knife (18) to oscillate the knife (18), about said axis (29) of rotation, between a first position in which the knife (18) and the cutting block (17) are located on opposite sides of the feed path (P), and a second position in which the blade (30) and the counterblade (22) are located on the same side of the feed path (P); the unit (1) being characterized in that the cutting block (17) comprises a contact surface (21) located along the feed path (P) upstream from the counterblade (22); and the knife (18) comprises an incision member (31) integral with the blade (30) and facing the contact surface (21) to press the strip (12) against the contact surface (21) when the knife (18) is in the second position.

2. A unit as claimed in claim 1, wherein the contact surface (21) comprises a number of slits (23*a*, 23*b*), and the incision member (31) comprises a number of incision elements (33*a*, 33*b*); the incision elements (33*a*, 33*b*) cooperating with said slits (23*a*, 23*b*) to form fold lines (7) and incisions (10) on the strip (12) when the knife (18) is in said second position.

3. A unit as claimed in claim 1, wherein said actuating means (19) are cam actuating means.

4. A unit as claimed in claim 1, wherein the actuating means (19) comprise a rotary cam (36); a rocker arm (26) fitted to said axis (29) of rotation; and a cam follower (35) interposed between the cam (36) and the rocker arm (26); the knife (18) being connected rigidly to the rocker arm (26).

5. A unit as claimed in claim 1, wherein the actuating means (19) comprise a reaction assembly (37) located on the opposite side of the knife (18) to the cutting block (17) and connected to the incision member (31) to absorb a reaction force transmitted by the contact surface (21) to the incision member (31) when the knife (18) is in the second position.

6. A unit as claimed in claim 5, wherein the reaction assembly (37) comprises a crank (38) mounted to oscillate about a relative axis (40) parallel to said axis (29) of rotation; a first connecting rod (45) interposed between the crank (38) and the rocker arm (26); and a second connecting rod (41) interposed between the crank (38) and the incision member (31); the crank (38) being moved, by the rocker arm (26) and the first connecting rod (45), between a rest position corresponding to said first position, and a work position corresponding to said second position; the crank (38) and the second connecting rod (41) being aligned with each other and substantially perpendicular to the contact surface (21) when the crank (38) is in said work position.

* * * * *